US007226345B1

(12) United States Patent
Dornfeld et al.

(10) Patent No.: US 7,226,345 B1
(45) Date of Patent: Jun. 5, 2007

(54) CMP PAD WITH DESIGNED SURFACE FEATURES

(75) Inventors: David Dornfeld, Berkeley, CA (US); Sunghoon Lee, Albany, CA (US)

(73) Assignee: The Regents of The University of California, Oakland, CA (US)

( * ) Notice: Subject to any disclaimer, the term of this patent is extended or adjusted under 35 U.S.C. 154(b) by 0 days.

(21) Appl. No.: 11/297,964

(22) Filed: Dec. 9, 2005

(51) Int. Cl.
*B24D 13/14* (2006.01)

(52) U.S. Cl. ..... 451/285; 451/41; 451/56; 451/287; 51/398

(58) Field of Classification Search ..... 451/36, 451/41, 56, 60, 921, 285–290, 530, 548; 51/398, 407, 401, 395
See application file for complete search history.

(56) References Cited

U.S. PATENT DOCUMENTS

| | | | | |
|---|---|---|---|---|
| 4,393,628 | A | 7/1983 | Ottman et al. | |
| 4,466,218 | A | 8/1984 | Ottman et al. | |
| 4,613,345 | A | 9/1986 | Thicke et al. | |
| 5,020,283 | A | 6/1991 | Tuttle | |
| 5,152,917 | A | 10/1992 | Pieper et al. | |
| 5,177,908 | A | 1/1993 | Tuttle | |
| 5,212,910 | A * | 5/1993 | Breivogel et al. | 451/530 |
| 5,216,843 | A | 6/1993 | Breivogel et al. | |
| 5,234,867 | A | 8/1993 | Schultz et al. | |
| 5,257,478 | A | 11/1993 | Hyde et al. | |
| 5,287,663 | A | 2/1994 | Pierce et al. | |
| 5,297,364 | A | 3/1994 | Tuttle | |
| 5,304,223 | A | 4/1994 | Pieper et al. | |
| 5,310,455 | A | 5/1994 | Pasch et al. | |
| 5,394,655 | A | 3/1995 | Allen et al. | |
| 5,421,769 | A | 6/1995 | Schultz et al. | |
| 5,435,816 | A | 7/1995 | Spurgeon et al. | |
| 5,454,844 | A | 10/1995 | Hibbard et al. | |
| 5,489,233 | A | 2/1996 | Cook et al. | |
| 5,516,409 | A | 5/1996 | Kambara | |
| 5,549,961 | A | 8/1996 | Haas et al. | |
| 5,558,563 | A | 9/1996 | Cote et al. | |
| 5,564,965 | A | 10/1996 | Tanaka et al. | |
| 5,578,362 | A | 11/1996 | Reinhardt et al. | |

(Continued)

FOREIGN PATENT DOCUMENTS

| | | |
|---|---|---|
| EP | 0845328 A3 | 6/1998 |

(Continued)

OTHER PUBLICATIONS

Lawig, A. Scott; "Pad Conditioning and Pad Surface Characterization in Oxide Chemical Mechanical Polishing"; 2002, *Mat. Res. Soc. Symp. Proc.*, vol. 732E, pp. 5.3.1-5.3.6.

(Continued)

*Primary Examiner*—Lee D. Wilson
*Assistant Examiner*—Anthony Ojini
(74) *Attorney, Agent, or Firm*—Townsend and Townsend and Crew LLP

(57) ABSTRACT

A polishing pad for use with a polishing composition is disclosed. The polishing pad includes a layer having a first material, and polishing structures having a second material, where the plurality of polishing structures form a temporary reservoir region for the polishing composition. The second material is harder than the first material.

14 Claims, 8 Drawing Sheets

U.S. PATENT DOCUMENTS

| | | | |
|---|---|---|---|
| 5,609,719 | A | 3/1997 | Hempel |
| 5,624,304 | A | 4/1997 | Pasch et al. |
| 5,628,862 | A | 5/1997 | Yu et al. |
| 5,645,469 | A | 7/1997 | Burke et al. |
| 5,650,039 | A | 7/1997 | Talieh |
| 5,664,989 | A | 9/1997 | Nakata et al. |
| 5,690,540 | A | 11/1997 | Elliott et al. |
| 5,692,950 | A | 12/1997 | Rutherford et al. |
| 5,725,417 | A | 3/1998 | Robinson |
| 5,725,420 | A | 3/1998 | Torii |
| 5,738,567 | A | 4/1998 | Manzonie et al. |
| 5,759,918 | A | 6/1998 | Hoshizaki et al. |
| 5,769,699 | A | 6/1998 | Yu |
| 5,778,481 | A | 7/1998 | Amsden et al. |
| 5,782,675 | A | 7/1998 | Southwick |
| 5,785,584 | A | 7/1998 | Marmillion et al. |
| 5,842,910 | A | 12/1998 | Krywanczyk et al. |
| 5,871,392 | A | 2/1999 | Meikle et al. |
| 5,876,269 | A | 3/1999 | Torii |
| 5,888,121 | A | 3/1999 | Kirchner et al. |
| 5,888,126 | A | 3/1999 | Hirose et al. |
| 5,893,755 | A | 4/1999 | Nakayoshi |
| 5,899,745 | A | 5/1999 | Kim et al. |
| 5,899,799 | A | 5/1999 | Monzonie et al. |
| 5,900,164 | A | 5/1999 | Budinger et al. |
| 5,910,043 | A | 6/1999 | Manzonie et al. |
| 5,921,855 | A | 7/1999 | Osterheld et al. |
| 5,932,486 | A | 8/1999 | Cook et al. |
| 5,934,977 | A | 8/1999 | Marmillion et al. |
| 5,958,794 | A | 9/1999 | Bruzvoort et al. |
| 5,984,769 | A | 11/1999 | Bennett et al. |
| 6,007,407 | A | 12/1999 | Rutherford et al. |
| 6,030,899 | A | 2/2000 | Cook et al. |
| 6,117,775 | A | 9/2000 | Kondo et al. |
| 6,390,891 | B1 * | 5/2002 | Guha et al. ..... 451/41 |
| 6,520,843 | B1 * | 2/2003 | Halley ..... 451/285 |
| 6,620,031 | B2 * | 9/2003 | Renteln ..... 451/41 |
| 6,679,769 | B2 | 1/2004 | Pinheiro et al. |
| 6,776,699 | B2 | 8/2004 | Amano et al. |

FOREIGN PATENT DOCUMENTS

| | | | |
|---|---|---|---|
| EP | 0874390 | A1 | 10/1998 |
| EP | 0919336 | A2 | 6/1999 |
| WO | WO 99/55493 | A1 | 11/1999 |

OTHER PUBLICATIONS

Lee, Sunghoon et al.; "Micro Feature Pad Development and Its Performance in Chemical Mechanical Planarization"; 2004, *Mat. Res. Soc. Symp. Proc.*, vol. 818, pp. K.5.1.1-K.5.1.5.

Lee, Sunghoon et al.; "Design rules for CMP pad based on pad-characterization and its protype fabrication using micro molding"; 2005, *9th International Chemical-Mechanical Planarization for ULSI Multilevel Interconnection Conference*, 8 pages.

Lee, Sunghoon et al.;"Performance of a novel controlled-contact area pad for CMP"; *Department of Mechanical Engineering, University of California*, 1 page.

Lee, Sunghoon et al.;"Design rules for CMP pad based on pad-characterization and its protype fabrication using micro molding"; 2005, *CMP-MIC*, 2 pages.

Lee, Sunghoon et al.;"Study on the effects of pad design in CMP"; 2005, *2nd Pac-rim international conference on planarization CMP and its application technology,* 4 pages.

Yoshida, Takafumi; "Pad Asperity Parameters for CMP Process Simulation"; 2004, *Mat. Res. Soc. Symp. Proc.*, vol. 816, pp. K.8.4.1-K.8.4.6.

* cited by examiner

Type C

IC 1000/SUBA400

Type C pad

CMP PAD WITH DESIGNED SURFACE FEATURES

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

BACKGROUND OF THE INVENTION

In a typical CMP (chemical mechanical polishing) process, a semiconductor wafer is placed face-down under high pressure on a polishing pad in the presence of a slurry. The slurry includes abrasives and chemical components. After the wafer is exposed to the slurry, a chemical reaction occurs between the chemical components in the slurry and the materials in the semiconductor wafer. The chemically reacted surface of the semiconductor wafer is then mechanically polished by the abrasives in the slurry.

At the macroscopic level, when fresh slurry is deposited onto the polishing pad, it stays on the pad temporarily and is supplied to the pad/wafer interface by the rotation of the polishing pad. At the microscopic level, the abrasives are supported by asperities in the polishing pad to remove material at the nano-scale on the wafer.

Many defects can be generated by conventional CMP pads. Such defects include dishing, erosion, thinning, and micro-scratches. Such CMP-related defects are well known in the art of semiconductor processing.

Since the polishing process is influenced by the characteristics of the polishing pad, it is desirable to understand the physics associated with the polishing pad to reduce the likelihood of CMP related defects. Compared to the amount of research that has been performed on CMP slurries, very little research has been performed on the design and fabrication of polishing pads. As will be apparent from the discussion below, the present inventors have characterized a conventional polishing pad and have also invented new polishing pads with new features.

A conventional pad may be made of polyurethane. The region near the contact surface of the conventional polishing pad can have a porosity of 30% to 50% (each pore may have a diameter of about 40 μm to 60 μm). Each pore in the polishing pad is separated or defined by wall structures. Such wall structures may also form asperities having widths of about 10 to about 50 μm. In a conventional polishing pad, there are also peaks and valleys that are continuously regenerated by conditioning.

Based on prior research by the present inventors, the side view of a pad can be categorized into three regions. They include the reaction region, the transition region, and the reservoir region (see FIG. 1(*a*)). The reaction region is mainly composed of wall structures. In the reaction region, the polishing pad and wafer contact abrasives within the slurry. The reservoir region includes pores which provide a region for holding new slurry. The fresh slurry that is supplied to the reaction region can be temporarily held in the reservoir region. It also flows through the transition region to the reaction region. That is, the transition region, which includes pores and walls, is the region where slurry is transported from the reservoir region to the reaction region.

As shown in FIG. 1(*a*), a conventional polishing pad has a wavy surface profile consisting of peaks and valleys. The contact between the wafer and pad occurs at the crests of the polishing pad in the reaction region. Fresh slurry temporarily collects in the valleys in the reservoir region and is supplied to the reaction region via the movement of the wafer between the peaks and valleys in the transition region during the polishing process. From a three-dimensional analysis, it was determined that the reservoir region is surrounded by the reaction region. Using these structures, the slurry on the bottom of the polishing pad is efficiently guided to the reaction region.

The degradation of a conventional pad is mainly caused by abrasion in the reaction region and plastic deformation. As a result of the wavy profile associated with a conventional polishing pad, the real contact area increases and the real contact pressure drops rapidly during the CMP process, causing the material removal rate (MRR) to decrease dramatically in the absence of a conditioning process. In addition, pad asperities with convex shapes concentrate stress at the areas where the polishing pad contacts the semiconductor wafer being polished, thus increasing the likelihood of dishing and erosion defects.

It would be desirable to provide for an improved polishing pad that addresses the above problems and other problems, individually and collectively.

SUMMARY OF THE INVENTION

Embodiments of the invention are directed to polishing pads, CMP apparatuses, and methods for making polishing pads.

One embodiment of the invention is directed to a polishing pad for use with a polishing slurry, the polishing pad comprising: a layer comprising a first material; and a plurality of polishing structures comprising a second material, wherein the plurality of polishing structures form a temporary reservoir region for the polishing slurry, wherein the second material is harder than the first material.

Another embodiment of the invention is directed to a polishing pad for use with a polishing slurry, the polishing pad comprising: a layer comprising a first material; and a plurality of polishing structures comprising a second material, each of the polishing structures having a contact area dimension of less than about 50 microns, and wherein a ratio of a real contact area for the polishing pad to an overall area of a substrate being polished is between about 15 and 25 percent, wherein the second material is harder than the second material.

Another embodiment of the invention is directed to a polishing pad for use without a slurry containing an abrasive (so-called abrasive-less slurry) such as used in chemical polishing or electrochemical mechanical polishing (both use a fluid with specific chemical properties but without abrasives or other particles.).

Another embodiment of the invention is directed to a polishing pad for use with a polishing composition, the polishing pad comprising: a continuous layer comprising a first material; and a plurality of polishing structures comprising a second material, wherein the polishing structures in the plurality of polishing structures are separated from each other and are direct contact with the continuous layer, wherein the second material is harder than the first material.

Other embodiments of the invention are directed to CMP apparatuses with the above described polishing pads.

Another embodiment of the invention is directed to a method for forming a polishing pad, the method comprising:

forming a pattern in a first molding substrate; forming a second molding substrate from the first molding substrate, wherein the second molding substrate includes a plurality of recesses; filling the recesses with a second material; forming a layer comprising a first material on the second material within the recesses to form a polishing pad, wherein the second material is harder than the first material; and separating the polishing pad from the second molding substrate.

These and other embodiments of the invention are described in further detail below.

BRIEF DESCRIPTION OF THE DRAWINGS

FIG. 1(*b*) shows a cross-sectional view of a substrate to be polished.

FIG. 2(*b*) shows a perspective view of the Type A polishing pad.

FIG. 2(*c*) shows a plan view of a Type B polishing pad.

FIG. 2(*d*) shows a perspective view of the Type B polishing pad.

FIG. 3(*b*) shows a side cross-sectional view of a portion of a polishing pad of the type shown in FIG. 2(*b*).

DETAILED DESCRIPTION

Embodiments of the invention are directed to polishing pads, CMP apparatuses with the polishing pads, and methods for making polishing pads. The polishing pads are preferably used with polishing slurries. Typical polishing slurries include a chemical component such as an acid, and an abrasive material such as abrasive particles. Such embodiments are specifically described below. However, in other embodiments of the invention, the polishing pads can also be used in a "slurryless" CMP process. In a slurryless CMP process, the liquid or semi-solid polishing composition that flows between the substrate being polished and the polishing pad can include just a chemical component, and need not include the abrasive material that is normally present in a normal CMP slurry. In addition, in yet other embodiments, the polishing pads according to embodiments of the invention can be used in an "e-CMP", or electronic CMP process. In an e-CMP process, a CMP pad or a portion thereof can be electrically biased to help erode, for example, a copper line to be polished. A typical e-CMP process can be characterized as a "reverse plating" process as copper to be polished is electrochemically removed from a semiconductor wafer. Thus, in embodiments of the invention, a "polishing composition" may include any suitable liquid or semi-solid media including slurries, slurryless compositions, e-CMP compositions, etc.

Figure 1A:
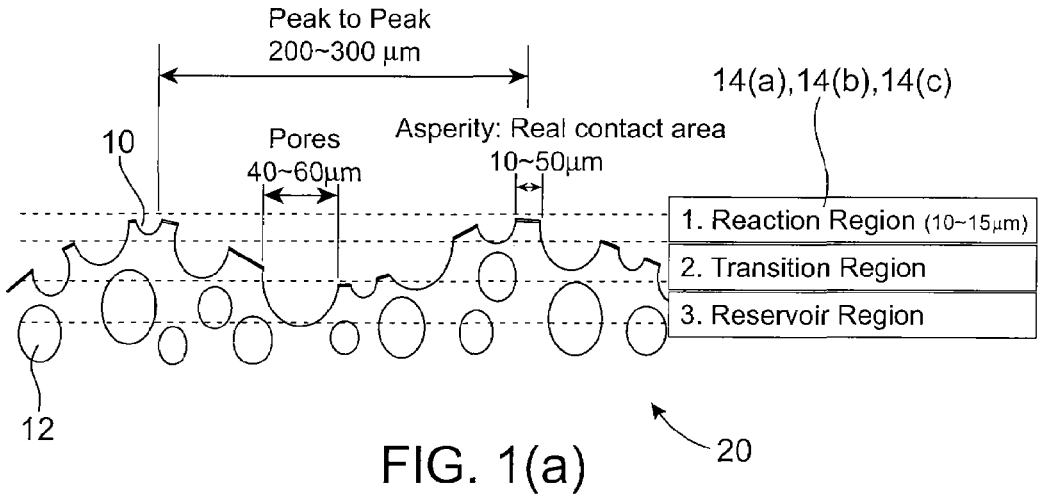
FIG. 1(*a*) shows schematic view of a conventional CMP pad structure, that has been analyzed by the present inventors.
Figure 1B:
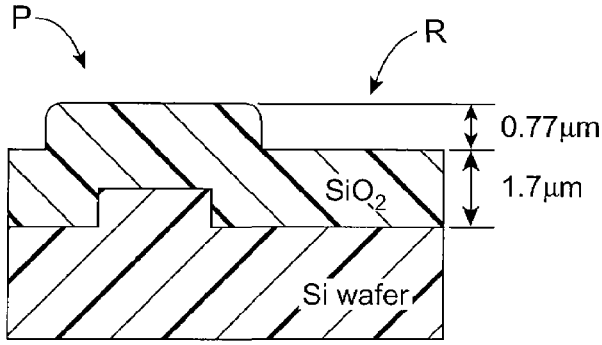
Figure 2A:
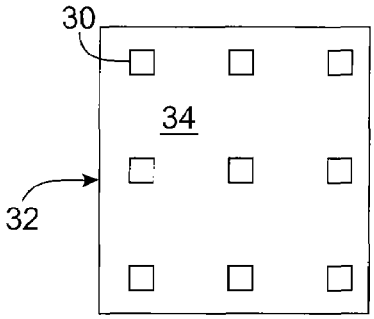
FIG. 2(*a*) shows a plan view of a Type A polishing pad according to an embodiment of the invention.
Figure 2C:
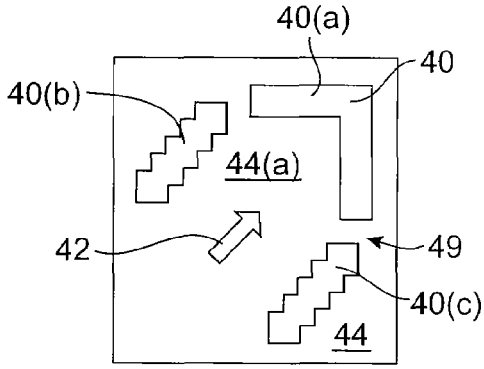
Figure 2B:
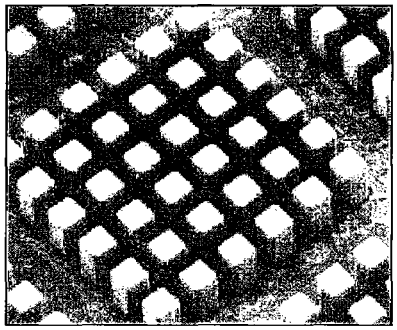
Figure 2D:
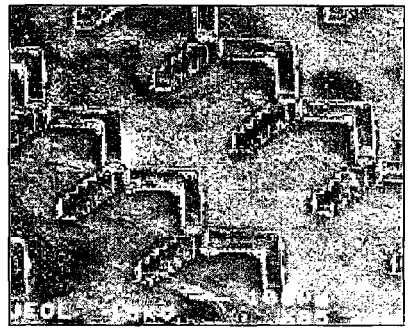

A typical substrate to be polished is shown in FIG. 1(*b*). As shown in FIG. 1(*b*), the substrate includes a patterned region P and a recessed region R. The polishing pads according to embodiments of the invention can polish the patterned region P so that it is level or substantially level with the recessed region R. In an ideal situation, very little or none of the recessed region R is removed during the polishing process. Embodiments of the invention are directed to polishing pads that have a high material removal rate (MRR) in the regions of a substrate to be polished, while having a low material removal rate (MRR) in the regions of the substrate that are not supposed to be polished. Thus, embodiments of the invention have high selectivity.

In embodiments of the invention, a number of design rules may be employed. For example, the contact area between a polishing pad and a substrate that is being processed is preferably substantially constant during a CMP process. This is done to prevent a sudden decrease in the material removal rate (MRR) and to decrease potential inadvertent stress concentration problems. By preventing a sudden decrease in the material removal rate, the likelihood of producing defects such as dishing is reduced. Accordingly, a polishing pad according to a preferred embodiment of the invention has features such as a substantially constant contact area, no diamond conditioning, and a topography independent pattern. As will be explained in further detail below, the polishing pads according to embodiments of the invention can also be fabricated using micro-molding technology.

The design rules that are used to design a polishing pad according to an embodiment of the invention may focus on macro, micro and/or nano-scale pad characteristics.

At the macroscopic level, the pad design characteristics may focus on stacked substructures and slurry channels in a top layer of a polishing pad. The top layer of the pad may include polishing structures that are used to polish a semiconductor wafer. As will be explained below, these polishing structures may have different shapes and/or may form slurry channels.

In a CMP process, uniform polishing and planarity are preferably achieved together. Hard pads are good for achieving planarity, while soft pads are good for achieving uniformity. However, a polishing pad with only a continuous hard layer concentrates stress in the wafer pattern being polished. Due to potential uneven stress distribution, polishing defects can be generated. Such defects include a wavy surface in an ILD (inter layer dielectric), and dishing or erosion in metal.

To address these problems, the stiff polishing structures in the polishing pad can form a discontinuous layer and can be isolated from each other. They can be supported by, and be in direct contact with, a continuous layer that is softer than the discontinuous layer including the polishing structures. Using a polishing pad of this type, stress is applied independently to the stiff areas and is absorbed by the softer, more compliant layer. Uniform stress distribution is also provided across the wafer being processed.

To achieve high throughput, slurry is delivered into the interface between the wafer and the polishing pad in some embodiments. Used slurry is also removed from the region between the polishing structures in the polishing pad and the wafer being polished. The polishing pads according to embodiments of the invention can also have various channels to enhance the transport of slurry to and from the reaction region.

At the micro-scale level, the design of the contact area of the polishing pad is considered. To produce a stable material removal rate (MRR), the contact area of the polishing pad, which is formed by distal surfaces of the polishing pad structures, is preferably constant. The ratio of the real contact area (the polishing pad area that contacts the substrate to be polished) to the total area of the polishing pad overlapping the substrate can be between about 5 and 25 percent, preferably 10 to about 20 percent (or more preferably between about 13 to about 17 percent), for an acceptable material removal rate (MRR). The total area of the polishing pad facing the substrate to be polished includes the polishing pad portions that contact and that do not directly contact the substrate being polished, and may be the same as the planar dimensions of the substrate being polished.

When a constant contact area is used, a conditioning step can be avoided and the potential defects caused by the use of a conditioner be prevented. Conditioning of conventional CMP polishing pads is a process used to establish and maintain stable and acceptably high removal rates for ILD planarization. It is typically accomplished by applying a diamond-impregnated nickel disk to the pad surface using a controlled down force and sweep rate.

To improve the performance (e.g., the throughput) of the polishing process, the locations of the polishing pad contact areas can also be considered. That is, the polishing structures forming the contact area for a polishing pad can be designed to increase the slurry efficiency (i.e., the transport of fresh slurry to the reaction region and the transport of used slurry out of the reaction region). As will be described in further detail below, in embodiments of the invention, the transition region surrounds the reservoir region and slurry is efficiently and effectively transported to the reaction region of the polishing pad.

In a CMP process, the wafer surface is chemically etched by slurry and the etched surface is removed by abrasion caused by abrasives. At the reaction region, these abrasives are supported by walls. The contact region of the polished pad can have nano-scale features on a wall for more interactions between the abrasives and the wafer. These nano-scale features can be regenerated during the polishing process to provide for a constant contact area.

Table 1 below shows some preferable features of a polishing pad according to an embodiment of the invention.

TABLE 1

| Pad Design Features | | |
|---|---|---|
| Macro scale | Micro scale | Nano scale |
| Stacked layers (Hard/soft) | Constant contact area (polishing structures preferably have widths of | Compatible features to abrasive Constant re-generation |

TABLE 1-continued

| Pad Design Features | | |
|---|---|---|
| Macro scale | Micro scale | Nano scale |
| Slurry channels | about 10 to about 50 microns) The ratio of real contact area (preferably about 13 to 17%) Conditioning-less CMP High slurry efficiency | of nano scale surface roughness |

One embodiment of the invention is directed to a polishing pad for use with a polishing slurry, the polishing pad including a layer comprising a first material, and a plurality of polishing structures comprising a second material, wherein the plurality of polishing structures form a temporary reservoir region for the polishing slurry. The second material is harder than the first material. In addition, the polishing structures may be shaped as cubes, curved lines, straight lines, zig-zags, chevrons, blocks, cylinders, etc. They may also be small (e.g., having at least one vertical or lateral dimension of less than about 100 microns).

In embodiments of the invention, a polishing structure may have a contact area that has at least one dimension that is less than about 100 microns. For example, in embodiments of the invention, each polishing pad structure can have a width or dimension between about 10 microns and about 50 microns. The total contact area for an individual polishing structure according to an embodiment of the invention may be less than about 100 square microns in some embodiments. Each polishing structure may also have a height that is less than about 100 microns, or 40 microns in embodiments of the invention. It is understood that these dimensions may change as semiconductor linewidths decrease as a result of improvements in semiconductor technology.

When the individual polishing structures are in an array, they may be spaced at any suitable distance from each other. For example, the maximum space between adjacent polishing structures may be less than about 150 microns in some embodiments.

In addition, in preferred embodiments, the polishing structures are configured so that the slurry efficiency is increased. Polishing structures can be configured to form reservoir regions that can temporarily hold slurry. The reservoir regions may be defined by polishing structures that form enclosed or partially enclosed regions. In embodiments of the invention, reservoir regions may be formed by polishing structures that are formed as C-shapes, hexagons, squares, circles, ovals, etc.

Each reservoir region can be defined by polishing structures and may include at least one gap. The at least one gap provides a lateral fluid inlet and/or outlet for slurry to enter and/or exit the reservoir region. The dimension of a typical gap may be less than about 50 microns in some embodiments of the invention. If a gap is not present, the likelihood that the polishing pad may hydroplane during processing is increased.

The two-dimensional reservoir regions can have at least one dimension less than about 300 microns, and preferably have at least one dimension between about 50 and 300 microns. The total lateral area of an individual reservoir region can be less than about 500 square microns in some embodiments. In preferred embodiments, the total lateral area of an individual reservoir region can be between about 50 and 500 square microns, or less.

FIGS. 2(*a*)–2(*d*) show two types of polishing pads with two different types of polishing pad structures.

FIGS. 2(*a*) and 2(*b*) respectively show a top plan view and a top perspective view of a polishing pad labeled Type A. It includes an array of polishing structures in the form of cubes 30 on a support layer 34. Arrow 32 shows the direction of slurry flow. The main design focus of the illustrated pad is the reaction region. That is, the Type A design does not specifically take slurry efficiency into consideration. Each cube 30 has dimensions of about 40×40×40 $\mu m^3$.

FIGS. 2(*c*) and 2(*d*) respectively show a top plan view and a top perspective view of the polishing pad labeled Type B. The Type B pad is designed to increase slurry efficiency. When the polishing pad rotates, designed polishing structures guide slurry to the reaction region (contact area) of the polishing pad. By designing the polishing structures in this way, the reaction region can be controlled. As noted below, the transition and reservoir regions can be realized by designing polishing structures in an appropriate manner.

Referring to FIG. 2(*c*), a plurality of polishing structures 40 including a first polishing structure 40(*a*), a second polishing structure 40(*b*), and a third polishing structure 40(*c*) can form a C-shaped reservoir region 44(*a*) and can lie on a supporting layer 34. The first polishing structure 40(*a*) is V-shaped (i.e., chevron-like) and is oriented substantially perpendicular to the orientation of the slurry flow 42. In other embodiments, the V-shaped polishing structure 40(*a*) could alternatively be a straight polishing structure. As shown, the V-shaped first polishing structure 40(*a*) has a dimension that is about 40 microns. The second and third polishing structures 40(*b*), 40(*c*) are parallel to the direction of slurry flow 42 and are jagged. These jagged edges can be created to increase turbulence within the reservoir region 44(*a*).

Gaps 49 are between the first polishing structure 40(*a*) and the second and third polishing structures 40(*b*), 40(*c*) and provide exits locations for the slurry to exit the reservoir region 44(*a*). The gaps 49 can each have a width less than about 40 microns in some embodiments. The used slurry passes through the gaps 49 and downstream of the reservoir region 44(*a*) and the polishing structures 40(*a*), 40(*b*), 40(*c*). At the same time, new slurry passes into the reservoir region 44(*a*).

Referring to FIG. 2(*d*), the V-shaped first polishing structures and the corresponding C-shaped reservoir regions can form a line which is transverse to the direction of slurry flow. This impedes the flow of slurry and increases the residence time of the slurry at the locations of the polishing structures.

Figure 3A:
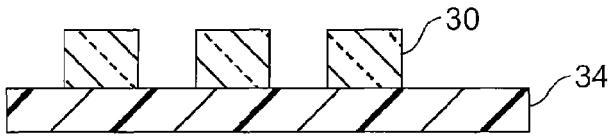
FIG. 3(*a*) shows a side cross-sectional view of a portion of a polishing pad of the type shown in FIG. 2(*a*).
Figure 3B:
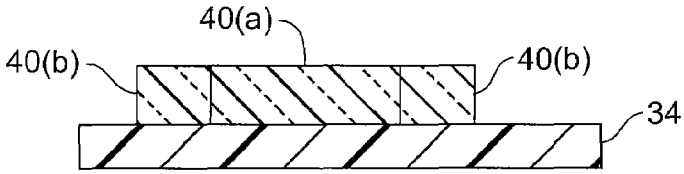

FIG. 3(*a*) shows a cross-sectional view of the Type A polishing pad shown in FIG. 2(*a*) in a direction perpendicular to the direction of the slurry flow 32. As shown, slurry can simply flow in the spaces between the polishing structures 30 and will simply pass downstream of the polishing structures 30 minimizing the time that the slurry is proximate the polishing structures 30.

FIG. 3(*b*) shows a cross-sectional view of the polishing pad shown in FIG. 2(*c*) in a direction perpendicular to the direction of slurry flow. Unlike the pad shown in FIG. 3(*a*), the slurry becomes temporarily trapped in the reservoir region 44(*a*) as the exit channels for the reservoir region 44(*a*) are generally perpendicular to the direction of slurry flow, instead of being parallel to the direction of slurry flow. This increases the residence time of the slurry in the vicinity of the polishing structures 40(*a*), 40(*b*), 40(*c*) thereby increasing the slurry efficiency.

Figure 4:
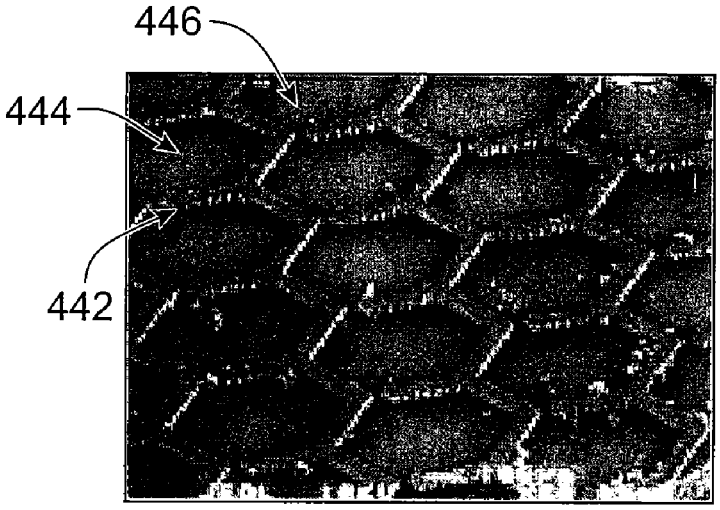
FIG. 4 shows a perspective view of a Type C pad according to an embodiment of the invention including honeycomb structures.

FIG. 4 shows a Type C pad according to an embodiment of the invention. The Type C pad includes honeycomb structures. As shown, each "cell" of the honeycomb resembles a reservoir region of a conventional pad, but is formed in a two-dimensional manner. This design maximizes slurry efficiency. Unlike the Type B pad described above, the Type C reservoir regions in the Type C pad are more clearly defined by the polishing structures. As shown, each reservoir region 444 is at least about 90% (or 95%) bounded by polishing structures 442. The other 10% (or 5%) or less can comprise gaps 446 which allow for the inflow and/or outflow of slurry from the reservoir regions 444.

Referring again to FIGS. 3(*a*) and 3(*b*), the polishing pads according to embodiments of the invention comprise at least two layers including a hard layer comprising the polishing structures (e.g., 30 in FIGS. 3(*a*) and 40(*a*), 40(*b*), and 40(*c*) in FIG. 3(*b*)) and a soft layer comprising a soft material (layer 34 in FIGS. 3(*a*) and 3(*b*)). Although the illustrated polishing pads have two layers, they may have more than one layer in other embodiments of the invention.

The soft layer comprising the soft material has a high compressibility and compliance, and serves to homogenize the pressure distribution over the wafer being polished. The hard layer, which is backed up by this soft layer, makes contact with the wafer and is used to achieve planarity. As noted above, to reduce the likelihood of creating defects, such as over polishing, dishing and erosion, the pads according to embodiments of the invention have a constant contact area composed of hard material. Only the isolated hard features make contact with the wafer, and stress is independently applied on the hard contact area and is absorbed by the soft layer. As a result, a uniform stress distribution is provided across the wafer being polished.

The hard layer including the polishing structures may include a wide variety of materials, such as organic polymers, inorganic polymers, ceramics, metals, composites of organic polymers, and combinations thereof. Suitable organic polymers can be thermoplastic or thermoset. Suitable thermoplastic materials include, but are not limited to, polycarbonates, polyesters, polyurethanes, polystyrenes, polyolefins, polyperfluoroolefins, polyvinyl chlorides, and copolymers thereof. Suitable thermosetting polymers include, but are not limited to, epoxies, polyimides, polyesters, and copolymers thereof. As used herein, copolymers include polymers containing two or more different monomers (e.g., terpolymers, tetrapolymers, etc.).

The organic polymers may or may not be reinforced. The reinforcement can be in the form of fibers or particulate material. Suitable materials for use as reinforcement include, but are not limited to, organic or inorganic fibers (continuous or staple), silicates such as mica or talc, silica-based materials such as sand and quartz, metal particulates, glass, metallic oxides, and calcium carbonate.

The materials in the soft layer may include resilient materials. Typically, the resilient material is an organic polymer, which can be thermoplastic or thermoset and may or may not be inherently elastomeric. The materials generally found to be useful resilient materials are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, ethylene/propylene rubbers, butyl rubbers, polybutadienes, polyisoprenes, EPDM polymers, polyvinyl chlorides, polychloroprenes, or styrene/butadiene copolymers. A particular example of a useful resilient material is a copolymer of polyethylene and ethyl vinyl acetate in the form of foam.

Resilient materials may also be of other constructions if the appropriate mechanical properties are achieved. The resilient material may also be a nonwoven or woven fiber mat of, for example, polyolefin, polyester, or polyamide fibers, which has been impregnated by a resin (e.g. polyurethane). The fibers may be of finite length (i.e., staple) or substantially continuous in the fiber mat.

Figure 5:
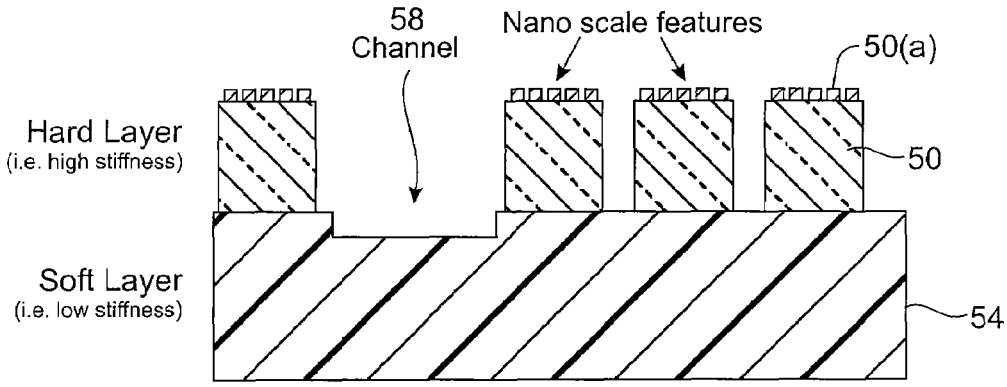
FIG. 5 shows a side cross-sectional view of a polishing pad according to another embodiment of the invention.

FIG. 5 shows a side cross-sectional view of a polishing pad according to another embodiment of the invention. As shown in FIG. 5, the polishing pad includes a support layer 54 that is relatively soft and a hard layer including polishing structures 50 that is relatively hard. A channel 58 for slurry flow is formed between some adjacent polishing structures 50. Each polishing structure 50 includes a number of discrete nanoscale features 50(*a*).

Figure 6:
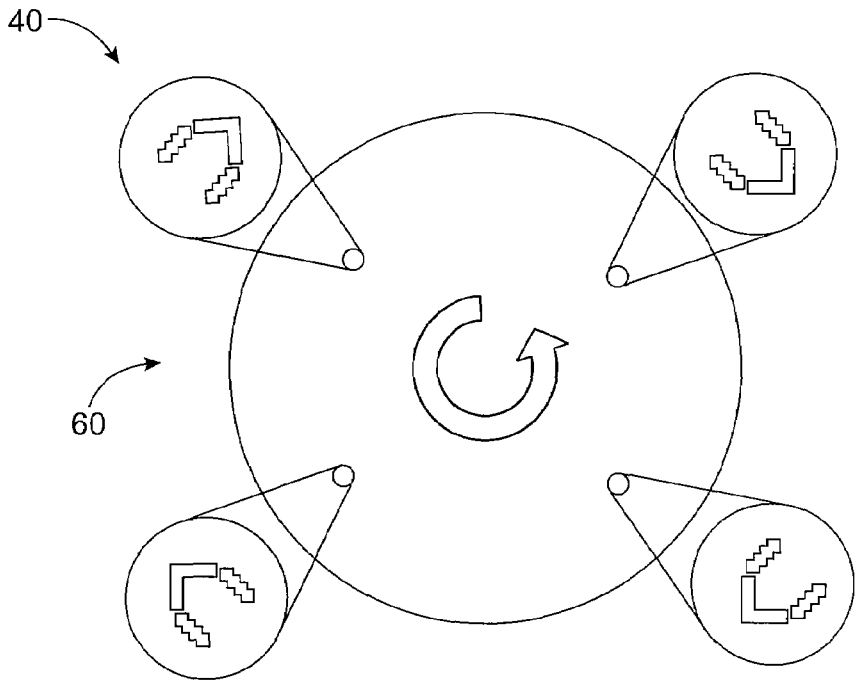
FIG. 6 shows a top plan view of a polishing pad according to an embodiment of the invention as it is used during polishing.

FIG. 6 shows a top plan view of a polishing pad 60 according to an embodiment of the invention. As shown, each of the group of polishing structures 40 forming a reservoir region may be oriented so that slurry flows into the reservoir region.

Figure 7:
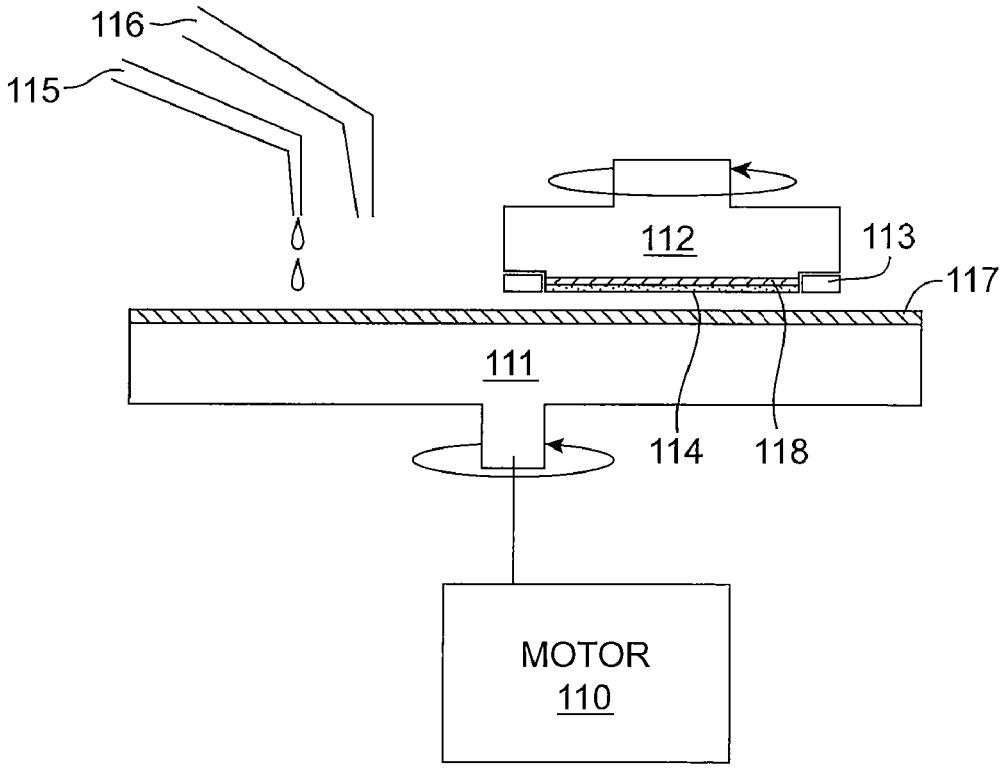
FIG. 7 shows a schematic view of a typical CMP apparatus.
Figure 8A:
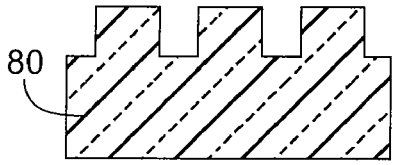
FIGS. 8(*a*)–8(*f*) show side cross-sectional schematic views of a polishing pad as it is being formed according to a method according to an embodiment of the invention.
Figure 8B:
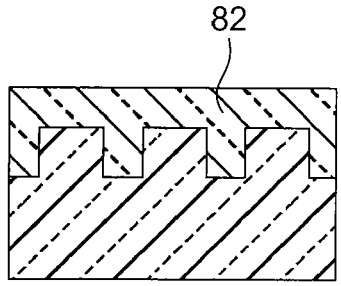
Figure 8C:
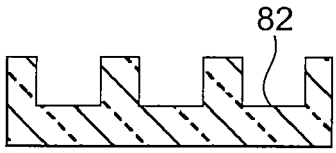
Figure 8D:
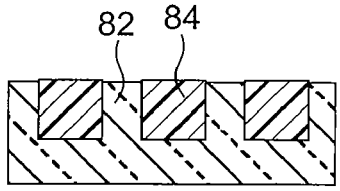
Figure 8E:
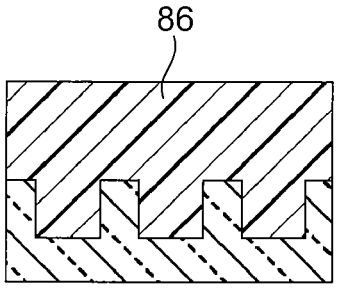
Figure 8F:
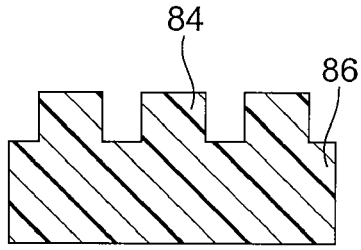
Figure 9A:
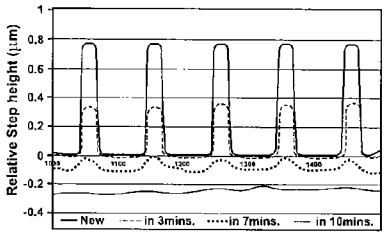
FIGS. 9(*a*)–9(*f*) show polishing data showing the effectiveness of the polishing pads (a. and d. for conventional pad, b. and e. for Type A pad, c. and f. for Type B pad) according to embodiments of the invention.
Figure 9B:
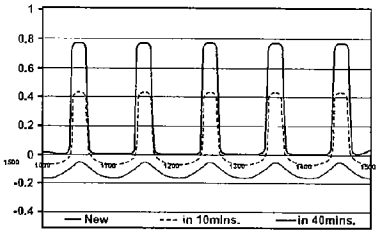
Figure 9C:
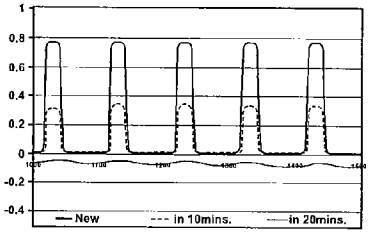
Figure 9D:
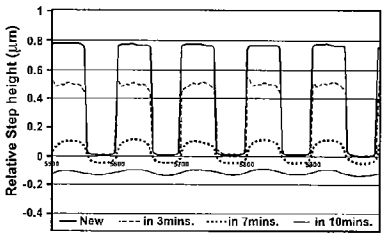
Figure 9E:
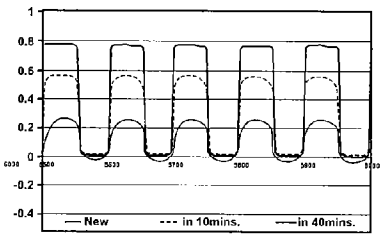
Figure 9F:
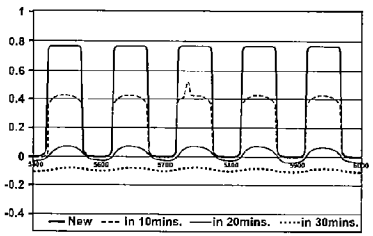

FIG. 7 shows a CMP apparatus that can use the above described polishing pads. The CMP apparatus includes a holder 112 which supports a wafer 114 via a backing pad 118. It is rotated above a platen 111 to which a polishing pad 117 is attached. A retainer ring 113 is provided so that the wafer does not come off during polishing. Supply nozzles 115, 116 may supply slurry or other process liquids to the polishing pad 117. A motor 110 may be coupled to the platen 111 to cause it to rotate. Other details regarding CMP apparatuses can be found in U.S. Pat. No. 6,910,942, which is assigned to the same assignee as the present application, and which is herein incorporated by reference in its entirety.

Although the polishing pads can be made using any suitable method, the polishing pads according to embodiments of the invention are preferably fabricated using micromolding. An exemplary micro-molding process is shown in FIGS. 8(*a*)–8(*f*). As shown in FIG. 8(*a*), new designs are patterned in a semiconductor wafer 80 (or other suitable temporary substrate) using an etching process (e.g., deep reactive ion etching (DRIE)) or any other suitable process. Grooves of any suitable size may be formed in the semiconductor substrate 80. For example, grooves that are about 40 microns deep, or more, may be formed in the semiconductor wafer 80. The semiconductor wafer 80 may constitute a first molding substrate.

The patterned wafer 80 is then used as a master for other temporary molds. Then, these are replicated on silicone rubber (PDMS) with a casting process. FIG. 8(*b*) shows a layer of silicone 82 that is deposited on a patterned silicon wafer 80. Suitable deposition processes include vapor deposition, roller coating, spin coating, etc. The silicone rubber layer 82 may constitute a second molding substrate. It is also noted that polymeric or non-polymeric materials other than silicone rubber may be used to form the second molding substrate.

As shown in FIG. 8(*c*), upon release, the patterned silicone rubber layer 82 is used as the mold for the pad. As shown in FIG. 8(*d*), small pockets (contact area) in the silicone rubber layer 82 are filled with a relatively stiff polymer 82. The stiff polymer material 82 is then cured. Suitable curing temperatures and conditions are known to those of ordinary skill in the art. Then, as shown in FIG. 8(*e*), a more compliant polymer material 86 is deposited on the stiff polymer 84. As shown in FIG. 8(*f*), the two layers separated from the silicon rubber layer 82 as a single polishing pad after curing.

EXAMPLE 1

To test the correlation between the pad design and slurry efficiency, a fluid simulation program, FLUENT, was used to analyze slurry flow characteristics. In this simulation, a 1 μm gap between a polishing pad and a semiconductor wafer to be polished and a 100 ml/min flow rate of slurry are assumed. Other properties of a conventional slurry are also assumed.

In the Type A pad described above, slurry flows into the spaces between the cube-shaped polishing structures. The resulting flow rate is determined to be low. Compared to the Type A pad (flow rate=$3.93\times10^{-11}$ kg/sec), the Type B pad shows a slurry flow rate (flow rate=$3.24\times10^{-10}$ kg/sec) that is eight times higher than the flow rate for the Type A pad. In the Type B pad, when new slurry flows in, the polishing structures guide the slurry into the contact area between the polishing pad and the semiconductor wafer being polished (in a similar manner to the transition and reservoir regions of a conventional pad). Thus, as illustrated by this example, by controlling the pad design features, slurry efficiency can be improved.

To evaluate the slurry efficiency and performance of the new pads, the performance of the Type A pad, the Type B pad, and an IC1000/Suba400 pad (a conventional pad) is analyzed. A six inch wafer is used as a master for pad fabrication, so the overall pad size is limited to six inches. The pad is attached to a platen of a small polishing machine.

Six three-inch patterned wafers are used for the polishing experiment. Each of these wafers has a 14,500 Å silicon dioxide film and density patterns ranging from 12% to 100%. D-7000 (Cabot Co.) slurry is used in the polishing experiment. The details of the experiment are listed in Table 1 below. Patterned wafers are polished separately on the conventional, Type A and Type B pads, and the wafer planarity for densities of 20% and 50% are primarily investigated.

TABLE 1

| | IC1000/ SUBA400 | Type A | Type B |
|---|---|---|---|
| Pad | | 60 rpm | |
| Wafer | | 3 inch wafer (12–100% density,1.45 μm SiO2) 30 rpm | |
| Slurry | | D-7000 (Cabot Co.) 100 ml/min | |
| Pressure | | 2.7 psi | |

To compare planarity-based performance, the material removal rate (MRR) on the patterned and recessed areas is measured separately with a NANOSPEC spectro-reflectometer before and after CMP. The pattern profiles are measured with an Alpha-step profiler and pattern evolutions are compared.

In an ideal ILD CMP process, only the patterned area is polished selectively and the recessed areas remain as they are. However, this is difficult to achieve in an actual CMP process due to the elastic deformation of the pad, which leads to pad asperities making contact with recessed areas.

In a conventional pad, the contact area formed by an asperity and wafer being polished is about 10 μm to about 50 μm. With 20% pattern density, the pattern width is about 20

μm, and the spacing of the lines is about 80 μm. With 50% pattern density, the pattern width is about 50 μm, and the spacing of the lines is about 50 μm. At the early stage, only the pattern is polished. As the step height decreases, the recessed area is polished by the pad asperities. As the asperity is smaller than the width of the recessed area, both the pattern and the recessed areas are polished together at a small step height.

In the Type A pad, the feature size is about 40×40 μm. On the 20% and 50% density patterns, the widths of the recessed areas are wider than the feature sizes, so that the recessed areas are also polished. As the cubes are isolated from each other, they are very weak and easily abraded. After 40 minutes of CMP, many of the cubes were worn out. Accordingly, the pattern was not planarized after 40 minutes of polishing time. The material removal rate is also lower than the Type B and conventional pad. The lower removal rate is due to the low slurry efficiency as predicted in the FLUENT simulation result and abrasion of pad features.

In contrast, the Type B pad demonstrates a lower removal rate in the recessed area and produces good planarity. Although the material removal rate (MRR) of the Type B pad is higher than the Type A pad, it is less than that of the conventional pad. The Type B pad requires a total polishing time of 20 minutes to match the thickness removed in 10 minutes of polishing with a conventional pad. This is attributed to the local stress on the reaction region. Generally, the conventional pad has spherically shaped contact areas. When it is pressed against on a wafer, the local stress on pad asperities is higher than the nominal pressure. In the case of the Type B pad, as the contact area is a flat surface, the local stress is the same as the nominal stress. Accordingly, the conventional pad exhibits a higher material removal rate (MRR) than the Type B pad.

Table 2a below depicts the MRR data for the patterned and recessed areas on 20% and 50% density patterns. Surface profile evolution graphs are shown in FIGS. 9(*a*)–9(*f*). Although a conventional pad shows a high MRR, over-polishing is about 2,500 Å after reaching planarization. However, the Type B pad does not polish the recessed area as much and over-polishing is under 800 Å. Hence, only the patterned area is removed and planarization is accomplished with only minimal material removal in the recessed areas.

TABLE 2a

| MRR Pad | | IC1000/ Suba400 (10 mins) | Type A (40 mins) | Type B (20 mins) |
|---|---|---|---|---|
| Density 20% | Pattern | 10,278 Å | 8248 Å | 7937 Å |
| | Recess | 2448 Å | 1371 Å | 438 Å |
| Density 50% | Pattern | 8990 Å | 5810 Å | 4485 Å |
| | Recess | 1450 Å | 270 Å | 152 Å |

Table 2b below shows the ratio of the MRR of the recessed area to the MRR for the patterned area for the various pads in Table 2a. As shown in Table 2b, embodiments of the invention polish less of the recessed area and more of the patterned area than conventional pads.

TABLE 2b

| | IC 1000 | Type A | Type B |
|---|---|---|---|
| Density 20% | 0.238 | 0.166 | 0.055 |
| Density 50% | 0.161 | 0.046 | 0.033 |

EXAMPLE 2

A six-inch wafer is used as a master for pad fabrication. The size of the produced polishing pad is six inches. The pad is made according to the above-described method, and has a configuration as shown in FIG. 5. It is attached to a small polishing machine.

Three six inch patterned wafers are then used for this experiment. Each wafer has a 17,000 Å silicon dioxide film and a density pattern ranging from 12% to 100%. D-7000 (Cabot Co.) slurry is used and an IC1000/SUBA400 (Rohm-Hass) pad is provided as a conventional pad for comparison. The detailed experiment conditions are in Table 3.

TABLE 3

| | IC1000/SUBA400 | Type B |
|---|---|---|
| Pad | 60 rpm | |
| Wafer | 3 inch wafer (12–100% density, 1.7 μm SiO2) | |
| | 30 rpm | |
| Slurry | D-7000 (Cabot Co.) | |
| | 100 ml | |
| Pressure | 1.6 psi | |

To compare the planarity performance, the MRR on the patterned area and the recess are measured separately with NANOSPEC before and after CMP. In the experiment, the patterned area and the recessed area are polished simultaneously, as expected. However, in contrast to the conventional pad, the new pad shows a lower MRR on the recessed area. The MRR of the new pad is smaller than the conventional pad. This is attributed to the higher ratio of the real contact area to total pad area in new pad.

Table 4a below shows the MRR data for the pattern and recess areas. The MRR of each pad is shown in Table 4a according to densities of 20%, 37% and 50%. In the case of the conventional pad, the recessed area is polished faster in low density patterns than high density patterns and the MRR of the recess increases as time goes on. Also, the new pad does not polish the recessed area until the relative step height reaches 1000 Å. So, only the pattern area is removed and planarization is accomplished.

TABLE 4a

| | IC1000/SUBA400 (for 12 minutes) | | Type B (for 40 minutes) | |
|---|---|---|---|---|
| | MRR on Pattern | MRR on Recess | MRR on Pattern | MRR on Recess |
| Density 20% | 7412 Å | 1065 Å | 7937 Å | 438 Å |
| Density 37% | 6786 Å | 964 Å | 6654 Å | 152 Å |
| Density 50% | 6201 Å | 783 Å | 4485 Å | 26 Å |

Table 4b below shows the ratio of the MRR of the recessed area to the MRR for the patterned area for the pads in Table 4a. As shown in Table 4b, the pad according to an embodiment of the invention polishes less of the recessed area and more of the patterned area than conventional pads. As shown below, the ratio can be less than 0.126 (preferably less than 0.1) for embodiments of the invention, while it can be greater than 0.126 for a conventional pad. As shown by the data in Table 4b, the ratio of the amount of recessed area removed to the amount of patterned material removed is significantly improved when embodiments of the invention are used.

TABLE 4b

| | IC 1000 | Type B |
|---|---|---|
| Density 20% | 0.144 | 0.055 |
| Density 37% | 0.142 | 0.023 |
| Density 50% | 0.126 | 0.006 |

EXAMPLE 3

In the Type C pad, the honeycomb structures play a role that is similar to the role of a well structure of a conventional pad. Using the Type C pad, it takes about 10 minutes to achieve planarization, which is faster than a conventional pad. The over-polished amount is about 1200 Å, which is almost half of that of a conventional pad.

Figure 10:
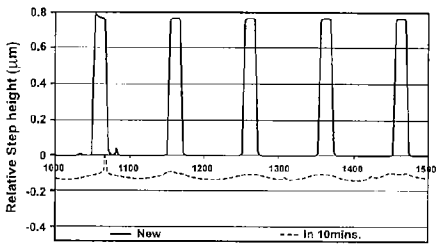
FIG. 10 shows a graph of polishing data using the Type C pad.

FIG. 10 shows the pattern evolution of a type C pad. From these results, it is experimentally verified that the pad designs affect the planarization results of $SiO_2$ CMP processes. In particular, the flat contact areas are desirable for good planarity. High removal rates are obtained using honeycomb structures, or other structures that form more enclosed reservoir regions.

To verify the ability of the Type C pad to perform a Cu CMP process, the performance of the Type C pad is investigated and compared with the performance of a conventional pad. A patterned Cu wafer (854AZ SEMATECH) is polished for this test. Slurry with a very low abrasive concentration is used. The experimental setup is same as the $SiO_2$ CMP test described above.

In the conventional pad test, a pressure of 1.2 psi is applied to the wafer. The removal rate is very low (i.e., 150 Å/min), and it takes 70 minutes to remove a 1 μm Cu film. On a 5 μm(Cu)/1 μm(Low-K) pattern, 300 Å of erosion and 1200 Å of dishing is found. On the 0.25 μm(Cu)/0.25 μm (Low-K) pattern, 300 Å of edge over erosion (EOE) is also found.

In contrast, the Type C pad shows much better performance. The removal rate is about 1000 Å/min even under a lower pressure of about 0.6 psi. After 10 minutes of polishing, about 1 μm of Cu film is removed. On a 5 μm/1 μm pattern, erosion is less than 100 Å and the dishing is 800 Å lower than the conventional pad. On a 0.25 μm/0.25 μm pattern, EOE is not observed.

Figure 11A:
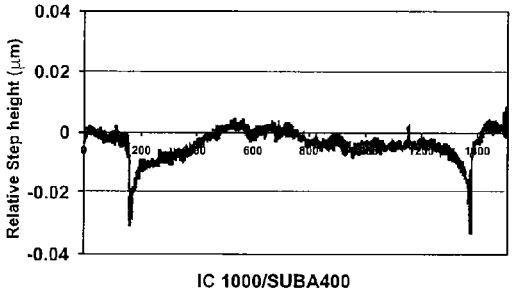
FIGS. 11(*a*) and 11(*b*) show profiles for 0.25 micron (Cu)/0.25 micron (low K) patterns after planarization using a conventional pad and a Type C pad according to an embodiment of the invention.
Figure 11B:
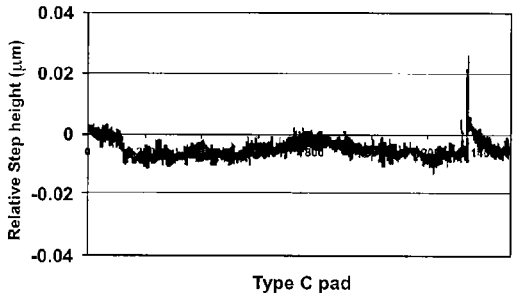
Figure 12A:
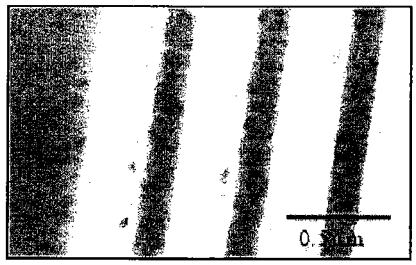
FIGS. 12(*a*) and 12(*b*) show SEM images of substrate sections that have been polished using a conventional pad and a pad according to an embodiment of the invention.
Figure 12B:
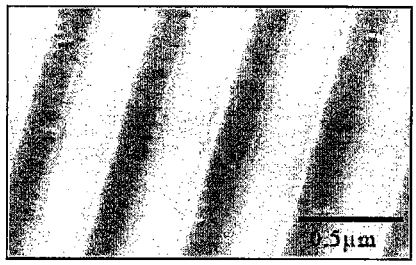

FIGS. 11(*a*) and 11(*b*) show the profiles of 0.25 μm/0.25 μm patterns after planarization. In a CMP process for a Cu/Low-K structure, the pressure is the most important process factor due to the fragility of the low-K material. When using the Type C pad, the working pressure is as low as that in e-CMP and the removal rate is much higher than that of a conventional pad. The 0.25 μm/0.25 μm patterns are investigated for defects with an SEM. In the case of a conventional pad, the copper pattern is found partly damaged after CMP. In comparison, fewer observable defects are found when the Type C pad is used. FIGS. 12(*a*) and 12(*b*) show the SEM images of the inspected pattern. As shown, the polishing result using the Type C pad is better than the polishing result using the conventional pad.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents. For example, although the polishing pads are preferably used in a CMP apparatus for polishing semiconductor wafers, they may be used to polish articles other than semiconductor wafers. Also, any one or more features of one embodiment may be combined with any one or more features of any other embodiment without departing from the spirit and the scope of the invention.

Any reference to positions such as "rear", "forward", "top", "bottom", "upper", "lower", etc. refer to the Figures and are used for convenience. They are not intended to refer to absolute positions.

A recitation of "a", "an" or "the" is intended to mean "one or more" unless specifically indicated to the contrary.

All patents, patent applications, publications, and descriptions mentioned above are herein incorporated by reference in their entirety for all purposes. None is admitted to be prior art.

What is claimed is:

1. A polishing pad for use with a polishing composition, the polishing pad comprising:

a layer comprising a first material; and a plurality of polishing structures comprising a second material, wherein the plurality of polishing structures form a temporary reservoir region for the polishing composition, wherein the second material is harder than the first material, wherein each of the plurality of polishing structures has a contact dimension not more than about 50 microns, and wherein a ratio of a contact area of the polishing pad to an area of a substrate being polished is less than about 17 percent.

2. The polishing pad of claim 1 wherein the polishing pad is used for a chemical mechanical polishing process.

3. The polishing pad of claim 1 wherein the reservoir region is formed by an array of polishing structures forming a substantially closed region.

4. The polishing pad of claim 1 wherein the second material comprises a resilient material.

5. The polishing pad of claim 1 wherein the reservoir regions are defined by arrays of polishing structures forming honeycomb-shaped cells.

6. A chemical mechanical polishing apparatus comprising:

the polishing pad of claim 1;

a substrate holder for holding a substrate to be polished using the polishing pad; and a motor operatively coupled to the polishing pad for rotating the polishing pad when the substrate is being polished.

7. A polishing pad for use with a polishing composition, the polishing pad comprising:

a layer comprising a first material; and a plurality of polishing structures comprising a second material, each of the polishing structures having a contact area dimension of less than about 50 microns, and wherein a ratio of a real contact area for the polishing pad to an overall area of a substrate being polished is between about 15 and 25 percent, wherein the second material is harder than the first material.

8. The polishing pad of claim 7 wherein the ratio is between about 15 and 17 percent.

9. The polishing pad of claim 7 wherein each polishing structure has a dimension between about 10 and 50 microns.

10. A chemical mechanical polishing apparatus comprising:

the polishing pad of claim 7;

a substrate holder for holding a substrate to be polished using the polishing pad; and a motor operatively coupled to the polishing pad for rotating the polishing pad when the substrate is being polished.

11. A polishing pad for use with a polishing composition, the polishing pad comprising:

a continuous layer comprising a first material; and a plurality of polishing structures comprising a second material, wherein the polishing structures in the plurality of polishing structures are separated from each other and are direct contact with the continuous layer, wherein the second material is harder than the first material, wherein each of the polishing structures has a contact area dimension of between about 10 to 50 microns, and wherein a ratio of a real contact area for the polishing pad to an overall area of the polishing pad is between about 13 and 17 percent.

12. The polishing pad of claim 11 wherein the polishing pad is used for a chemical mechanical polishing process.

13. The polishing pad of claim 11 wherein the polishing structures form honeycomb-shaped cells.

14. A chemical mechanical polishing apparatus comprising:

the polishing pad of claim 11;

a substrate holder for holding a substrate to be polished using the polishing pad; and a motor operatively coupled to the polishing pad for rotating the polishing pad when the substrate is being polished.

* * * * *